US008257121B2

(12) United States Patent
Taylor

(10) Patent No.: US 8,257,121 B2
(45) Date of Patent: Sep. 4, 2012

(54) BOAT PROPELLER SHIELD

(76) Inventor: Guy Taylor, Duchesne, UT (US)

( * ) Notice: Subject to any disclaimer, the term of this patent is extended or adjusted under 35 U.S.C. 154(b) by 15 days.

(21) Appl. No.: 12/833,654

(22) Filed: Jul. 9, 2010

(65) Prior Publication Data

US 2011/0009018 A1 Jan. 13, 2011

Related U.S. Application Data

(60) Provisional application No. 61/224,214, filed on Jul. 9, 2009.

(51) Int. Cl.
*B63H 5/16* (2006.01)

(52) U.S. Cl. ..... 440/71

(58) Field of Classification Search ..... 440/71, 440/72, 66; 114/164
See application file for complete search history.

(56) References Cited

U.S. PATENT DOCUMENTS 3,889,624 A 6/1975 Balius
5,127,353 A 7/1992 Wieser

FOREIGN PATENT DOCUMENTS

JP 05-310187 11/1993
JP 05-310188 11/1993

OTHER PUBLICATIONS http://www.propellersafety.com/propeller-guard-technologies/ Publication showning pivoting propeller guard dated Oct. 13, 2006.*
Possible Propeller Guard / Propeller Safety Technologies, http://www.rbbi.com/pgic/ptech/ptech.htm, Mar. 16, 2011.

* cited by examiner

*Primary Examiner* — Edwin Swinehart
(74) *Attorney, Agent, or Firm* — Kirton McConkie; Evan R. Witt

(57) ABSTRACT

A propeller shield that is designed to pivot over and away from a distal face of a propeller on a motorized boat. Generally, when the boat is at rest or moving in reverse through water, the propeller shield pivots down over the propeller's distal face and prevents accidental bodily contact with the propeller. As the boat moves forward in the water, the propeller shield pivots up and away from the propeller to allow the boat to move forward without the propeller shield causing an undesirable amount of drag or otherwise adversely affecting the boat's performance. Typically, the propeller shield has a shield member, which is sized and shaped to cover the propeller's distal face, and a connection mechanism, which attaches the shield member to the boat. In some cases, the shield member optionally comprises one or more fluid vents and hydroplane surfaces.

20 Claims, 4 Drawing Sheets

BOAT PROPELLER SHIELD

CROSS-REFERENCE TO RELATED APPLICATION

This application claims the benefit of U.S. Provisional Application No. 61/224,214, filed Jul. 9, 2009, entitled "Boat Propeller Shield," the entire disclosure of which is hereby incorporated by reference.

BACKGROUND OF THE INVENTION

1. Field of the Invention

The present invention relates generally to mechanisms for shielding boat propellers. More specifically, the present invention relates to a propeller shield that is designed to pivot over the distal face of a propeller when the boat is at rest or moving in reverse through water and to pivot away from the propeller when the boat is moving forward in the water.

2. Background and Related Art

The propeller of many motorized boats that have an outboard motor or an inboard/outboard motor typically rests below the bottom surface of the boat, at or near the boat's distal end (or stern), when the propeller is in use. Accordingly, as the propeller spins, it is able to propel the boat through the water. Due to its position, however, and the fact that the propeller typically spins at a very high RPM during use, the propeller poses a substantial safety risk to any person in proximity to the spinning propeller. For instance, should a passenger, a skier, a swimmer, or another person accidentally be hit by the spinning propeller, serious injury will inevitably result.

There are several prior art propeller guards that attempt to prevent a person from being injured by accidentally contacting a spinning propeller. A first example of a conventional propeller guard is an enclosure that includes a hollow cylindrical member that surrounds the lateral-most edges of the propeller. Such an enclosure is designed to allow water to have fluid flow access to the propeller in order to allow the propeller to function as intended while preventing objects (e.g., hands, feet, etc.) from contacting the sharp lateral edges of the propeller's blades.

Although such enclosures are somewhat successful in preventing objects from contacting the lateral-most edges of a spinning propeller, such enclosures often have several severe drawbacks. In one example, while certain conventional propeller guards cover the propeller's lateral-most edges, some guards do little to nothing to prevent objects from contacting the propeller from the propeller's distal face (or the portion of the propeller that faces away from the boat's bow). Accordingly, even with such an enclosure in place, a person could still be seriously injured by contacting the propeller from its distal face instead of from its sides.

In other instances, some conventional propeller guards tend to severely reduce the performance characteristics of the boat to which they are connected. For instance, some propeller guards cause instability, vibrations, control degradation, and unpredictability of motor response during use. In still other instances, some conventional guards can cause a significant amount of drag as the boat moves through the water. As a result, such guards can noticeably slow the boat and adversely affect its steering capabilities.

Accordingly, it would be an improvement in the art to provide improved systems and techniques to prevent people and other objects from accidentally contacting boat propellers as the propellers spin.

BRIEF SUMMARY OF THE INVENTION

This disclosure discusses a propeller shield that is designed to pivot over and away from a distal face of a propeller on a motorized boat. Generally, when the boat is at rest or moving in reverse through the water, the propeller shield pivots down over the propeller's distal face and prevents accidental bodily contact with the propeller. As the boat moves forward in the water, the propeller shield is caused to pivot up and away from the propeller so as to allow the boat to move forward without the propeller shield causing an undesirable amount of drag or otherwise adversely affecting the boat's performance.

In some non-limiting implementations, the propeller shield includes a shield member and a connection mechanism. With respect to the shield member, the shield member is sized and shaped to at least partially cover the propeller's distal face. In some cases, the shield member also comprises a plurality of vents that allow water to flow directly through the shield member in a manner that allows the boat to reverse when the propeller shield is engaged (or pivoted to cover the propeller's distal face). Additionally, the shield member optionally comprises one or more hydroplane members that lift the shield member in the water to reduce drag caused by the shield member as the boat moves forward. In some non-limiting implementations, the hydroplane member suspends the shield member above the surface of the water when the boat moves through the water at a relatively high speed.

With respect to the connection mechanism, this mechanism pivotally attaches the shield member to a portion of the boat (e.g., the lower unit of an outboard motor, the outdrive of an inboard/outboard motor, or any other suitable portion of the boat) so that the shield member can cover the propeller's distal face when the boat is at rest or in reverse. In some cases, to help lift the shield member from the water and reduce drag as the boat moves forward, the connection mechanism comprises an angled arm that extends between the shield member and the boat (e.g., a connection point on the outdrive).

These features and advantages of the present invention will become more fully apparent from the following description and appended claims, or may be learned by the practice of the invention as set forth hereinafter.

BRIEF DESCRIPTION OF THE SEVERAL VIEWS OF THE DRAWINGS

In order that the manner in which the above-recited and other features and advantages of the invention are obtained and will be readily understood, a more particular description of the invention briefly described above will be rendered by reference to specific embodiments thereof that are illustrated in the appended drawings. Understanding that these drawings depict only typical embodiments of the invention and are not therefore to be considered to be limiting of its scope, the invention will be described and explained with additional specificity and detail through the use of the accompanying drawings in which.

DETAILED DESCRIPTION OF THE INVENTION

Reference throughout this specification to "one embodiment," "an embodiment," or similar language means that a particular feature, structure, or characteristic described in connection with the embodiment is included in at least one embodiment of the present invention. Thus, appearances of the phrases "in one embodiment," "in an embodiment," and similar language throughout this specification may, but do not necessarily, all refer to the same embodiment.

Furthermore, the described features, structures, or characteristics of the invention may be combined in any suitable manner and in one or more embodiments. In the following description, numerous specific details are provided, such as examples of suitable propeller shields, components, materials, apparatus, processes, methods, etc., to provide a thorough understanding of embodiments of the invention. One skilled in the relevant art will recognize, however, that the invention may be practiced without one or more of the specific details or methods, or with other methods, components, characteristics, materials, and so forth. In other instances, well-known structures, materials, or operations are not shown or described in detail to avoid obscuring aspects of the invention.

The embodiments of the present invention will be best understood by reference to the drawings, wherein like parts are designated by like numerals throughout. It will be readily understood that the components of the present invention, as generally described and illustrated in the Figures herein, could be arranged and designed in a wide variety of different configurations. Thus, the following more detailed description of the embodiments of the propeller shield as represented in FIGS. 1A through 3, is not intended to limit the scope of the invention, as claimed, but is merely representative of some embodiments of the invention.

Figure 1A:
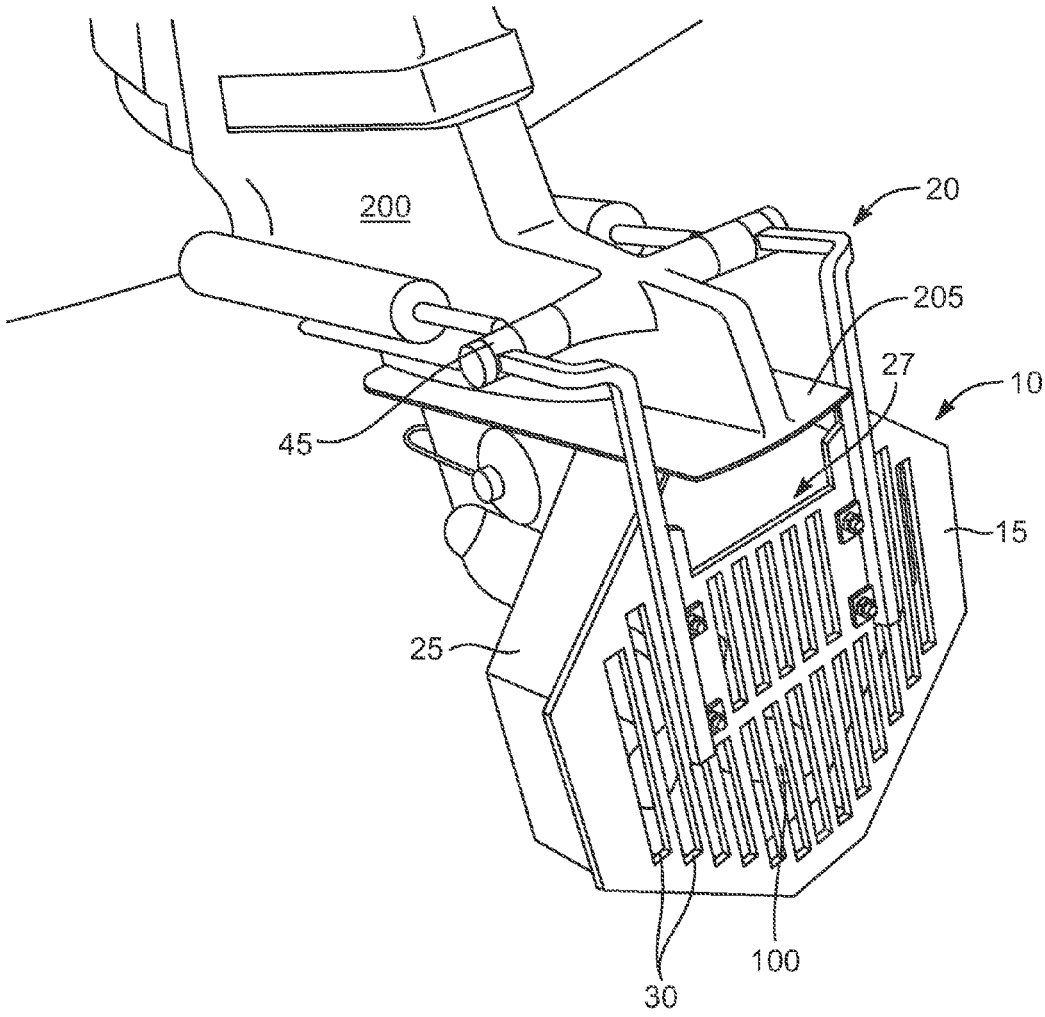
FIG. 1A illustrates a perspective view of a representative embodiment of a propeller shield connected to an outdrive of an inboard/outboard motor, wherein the propeller shield is in an engaged position.
Figure 1B:
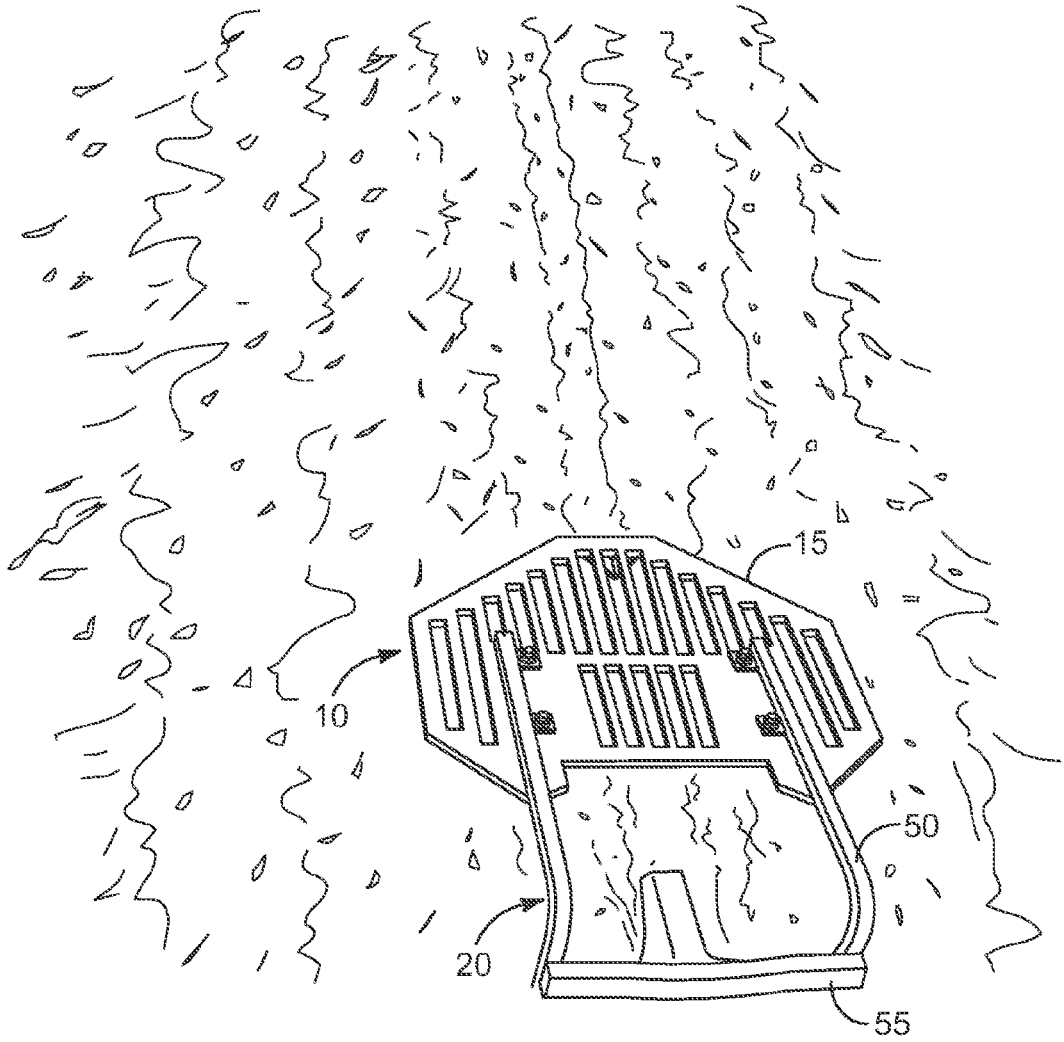
FIG. 1B illustrates a top perspective view of a representative embodiment of the propeller shield, wherein the propeller shield is in an unengaged position.

This disclosure discusses a propeller shield that is designed to pivot over and away from the distal face of a propeller on a motorized boat, depending on the speed and the direction in which the boat is moving through water. In some embodiments, when the boat (not shown) is at rest or moving in reverse in the water, the propeller shield 10 pivots down over the propeller's distal face (as shown in FIG. 1A) and prevents accidental bodily contact with the propeller. In contrast, in some non-limiting embodiments, as the boat moves forward, the movement of the boat forces the propeller shield 10 to pivot up and away from the propeller 100 in a manner that allows the boat to move forward without the propeller shield causing an undesirable amount of drag or otherwise adversely affecting the boat's performance.

The propeller shield can be connected to any suitable type of boat. In this regard, some examples of suitable types of boats include, but are not limited to, boats that have one or more outboard motors, boats that have one or more indoor/outdoor motors, and other boats that have one or more propellers located at or near their stern. By way of illustration, FIG. 1A illustrates a non-limiting embodiment in which the propeller shield 10 is pivotally attached to the outdrive 200 of an inboard/outboard motor. While the propeller shield can be sold with or separate from a boat, for simplicity, the following discussion focuses on using the propeller shield when it is attached to a boat.

While the propeller shield 10 can comprise any suitable component, FIG. 1A shows a non-limiting embodiment in which it comprises a shield member 15 and a connection mechanism 20. To provide a better understanding of the propeller shield, the shield member and the connection mechanism are described below in more detail.

With respect to the shield member 15, the shield member is generally configured to pivot over and cover, and to pivot away from and expose, the distal face of a boat's propeller. In this regard, the shield member may comprise any characteristic or component that allows it to function in this manner and to protect a person from contacting the propeller's distal face when the boat is resting in or reversing through water.

In one example of a suitable characteristic of the shield member 15, the shield member can have any suitable shape that allows function as intended. Some non-limiting examples of a suitable shape for the shield member include a shape that is substantially circular, ellipsoidal, polygonal (e.g., hexagonal, octagonal, etc.), or irregular. Additionally, while the propeller shield 10 need not be used with a propeller guard, in some non-limiting embodiments in which the propeller shield is used on a boat that also comprises a propeller guard, the propeller shield may be sized and shaped to substantially cover a distal opening of the propeller guard. By way of non-limiting illustration, FIG. 1A shows an embodiment in which the outer perimeter of the shield member 15 has somewhat of an octagonal appearance that corresponds, to some extent, with the shape and size of the propeller guard 25.

Where the propeller shield 10 is used with a propeller guard 25, the propeller shield can be used with any suitable propeller guard. By way of non-limiting example, FIG. 1A illustrates an embodiment in which the propeller shield 10 is used with an octagonal propeller guard 25. For a more detailed description of some suitable propeller guards, see U.S. Pat. No. 5,098,321, entitled "High Performance Boat Prop Guard with High Strength Attachment Bracket," and U.S. Pat. No. 6,159,062, entitled "High Performance Boat Prop Guard," the entire disclosures of which are incorporated herein by reference.

In another example of a suitable characteristic of the shield member 15, FIG. 1A shows that in some non-limiting embodiments, the shield member 15 optionally defines an indentation 27 that allows the shield member 15 to pivot over and away from the propeller 100 without contacting an anti-ventilation plate 205 on the motor (e.g., on the motor's outdrive unit 200).

In still another example of a suitable characteristic of the shield member 15, the shield member can be any suitable size that allows it to fulfill its intended purposes. Indeed, in some non-limiting embodiments, the shield member is sized so as to be substantially equal in size or larger than the circumference of the propeller 100 when the propeller is spinning. In other non-limiting embodiments, the shield member is sized and shaped to fit over the distal opening of a propeller guard 25 that surrounds the lateral-most edges of the propeller. Accordingly, the propeller shield can prevent accidental injury caused by bodily contact with the propeller's distal face while the propeller guard prevents objects from damaging, or being damaged by, the sharp edges of the spinning propeller.

In yet another example of a suitable characteristic of the shield member 15, in some non-limiting embodiments, the shield member comprises one or more vents that allow water to flow to the propeller 100 when the boat is reversing through water. As a result, in such embodiments, the boat is able to reverse through the water when the propeller shield is disposed over and at least partially occludes the propeller's distal face.

Where the shield member 15 comprises vents, the vents can be any shape or size that allows them to perform their intended functions. In this regard, the vents preferably provide sufficient open area to enable an adequate quantity of water to engage the propeller 100 when operated in reverse. Additionally, the vents should be small enough that the structured material of the shield member that defines the vents provides sufficient closed area to protect the propeller from unintended penetration of an object through the shield member. Some examples of suitable vent shapes include, but are not limited to, elongated slits, circles, squares, rectangles, polygons, irregular shapes, and virtually any other suitable shape that allows the shield member to function as intended. By way of non-limiting illustration, FIG. 1A illustrates an embodiment in which the shield member 15 comprises a plurality of elongated slits 30, which run vertically through the shield member.

The shield member 15 may be moved between its engaged position (FIG. 1A), over the propeller's distal face, and its unengaged position (FIG. 1B), away from the propeller 100, in any suitable manner. By way of non-limiting example, the shield member can be moved between its engaged and its unengaged position manually, by a mechanical mechanism (e.g., a motor, a hydraulic mechanism, a lever mechanism, a spring mechanism, etc.), and/or by gravity and by forces that are applied to the shield member 15 as it moves through the water.

In some non-limiting embodiments, the shield member 15 is engaged and disengaged by gravity and by forces that are applied to the shield member 15 by the spinning propeller 100 and by water as the shield member moves with respect to the water. In such embodiments, the shield member is able to move to the engaged position when the force applied to a proximal face of the shield member (or the face of the shield member that pivots to face the propeller's distal face) is less than the forces applied to the shield member by gravity. For instance, when the boat is resting or reversing in the water, gravity can cause the shield member to pivot down and at least partially occlude the propeller's distal face. In contrast, when the boat begins to move forward, water is forced against the shield member's proximal face, causing the shield member to pivot away from the propeller 100. As the speed of the boat increases and the forces on the shield member's proximal face also increase, more of the shield member is forced out of the water, causing the shield member to glide, skip, or otherwise skim across the water's surface (see e.g., FIG. 1B).

Figure 2:
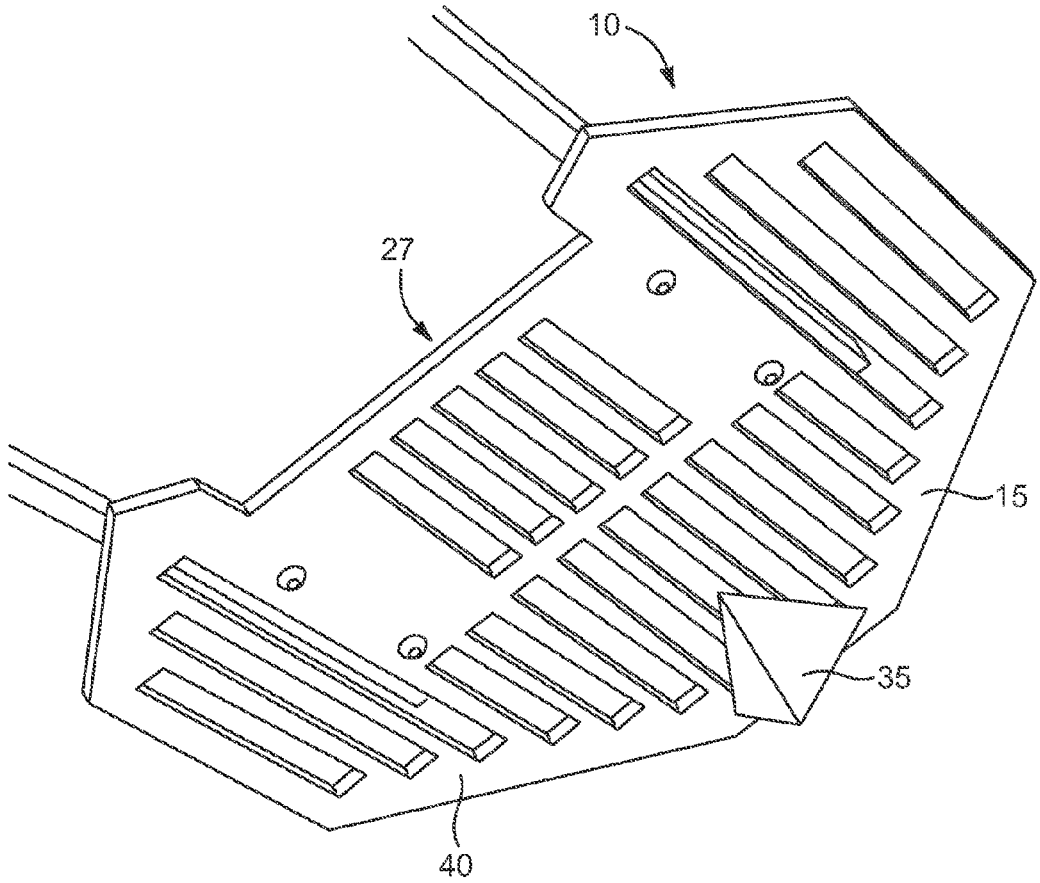
FIG. 2 illustrates a perspective view of a representative embodiment of a proximal face of a shield member of the propeller shield.

In order to reduce the drag caused by the shield member 15 as it skims through the water, some non-limiting embodiments of the shield member comprise one or more hydroplane members. In such embodiments, each hydroplane member can comprise any suitable surface that can hydroplane and lift the shield member in and/or out of the water as the boat moves forward through the water. By way of example, FIG. 2 illustrates a non-limiting embodiment in which the shield member 15 comprises a wedge-shaped fin 35 that is disposed on the shield member's proximal face 40 so as to extend away from that face 40. While FIG. 2 shows an embodiment in which the hydroplane member comprises a wedged shaped fin 35, the hydroplane member can have any other suitable shape, including, but not limited to, a semi-spherical shape, a semi-conical shape, a semi-pyramidal shape, or another suitable shape that extends away from the shield member's proximal face and allows the hydroplane member to raise the shield member in and/or out of water as the boat moves forward through the water.

Where the shield member 15 comprises a hydroplane member (e.g., the wedge-shaped fin 35), the hydroplane member can be disposed on the shield member in any suitable manner, including, without limitation, by being bent in, being integrally formed with, and being attached to the shield member.

Figure 3:
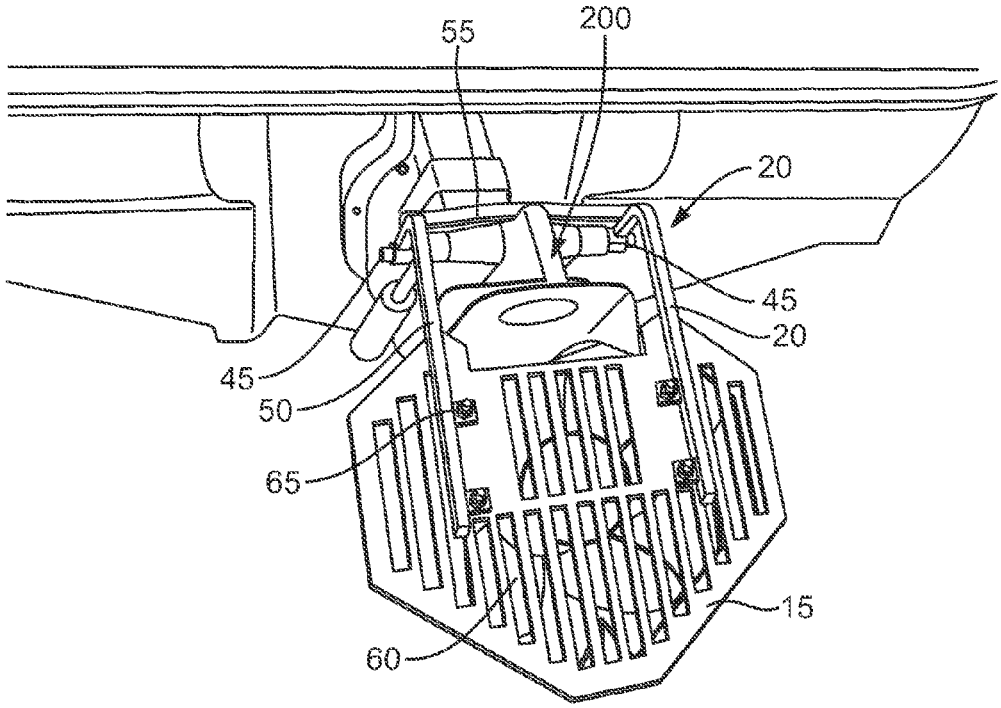
FIG. 3 illustrates a perspective view of a representative embodiment of the propeller shield connected to the outdrive of the inboard/outboard motor.

With reference now to the connection mechanism 20, the connection mechanism is generally configured to pivotally attach the shield member 15 to the boat. In this regard, the connection mechanism can attach the shield member to any suitable portion of the boat that allows the shield member to move between its engaged and its unengaged positions. Some examples of suitable attachment points include, but are not limited to, the lower unit of an outboard motor, the outdrive of an inboard/outboard motor, a portion of the boat, and any other suitable location. By way of illustration, FIG. 3 shows a non-limiting embodiment in which the connection mechanism 20 is pivotally connected to the hydraulic connection point(s) 45 of the motor's outdrive unit 200.

The connection mechanism 20 can also be connected to boat in any suitable manner, including, without limitation, through the use of one or more clamping mechanism, mechanical fasteners (e.g., bolts, rivets, etc.), and/or in any other suitable manner.

The connection mechanism 20 can comprise any suitable component that allows it to pivotally connect the shield member 15 to the boat and that allows the propeller shield 10 to function as intended. In one non-limiting example, the connection mechanism comprises one or more arms that are attached to the shield member and are pivotally connected to the boat (e.g., at the hydraulic connection point 45 on the outdrive 200). In this example, each arm can have any suitable characteristic. For instance, each arm can be substantially straight, curved, angled, and/or have any other suitable shape. By way of non-limiting illustration, FIG. 3 shows an embodiment in which the arms 50 are angled to have a substantially L-shaped appearance. Indeed, because angled arms that are connected to the hydraulic connection points 45 on the outdrive 200 (or any other suitable location) may allow the hydroplane member to lift more of the shield member 15 out of the water than would some straight arms, in some non-limiting embodiments, angled arms are preferred.

In addition to the aforementioned components and characteristics, the described propeller shield 10 can comprise any other suitable component or characteristic that allows it to function as intended. In one non-limiting example, the propeller shield comprises means for limiting the propeller shield's movement. In this example, the limiting means may comprise any suitable component that prevents the shield member 15 from actually contacting the propeller 100 and/or being pivoted away from the propeller past a desired point. While the propeller shield may comprise any suitable limiting means, FIG. 3 illustrates a non-limiting embodiment in which the limiting means comprises a shield member stop 55 that contacts an object on the boat to limit the propeller shield's movement. Specifically, FIG. 3 shows that the connection mechanism 20 comprises a bar 55 that is configured to contact a portion of the outdrive 200 and to, thereby, prevent the shield member 15 from contacting the propeller 100 and/or from pivoting too far away from the propeller. In another non-limiting embodiment in which the propeller shield 10 is used with a propeller guard 25 (see FIG. 1A), the propeller guard acts as the limiting means by preventing the shield member 15 from contacting propeller 100.

The various components of the propeller shield 10 may be made of any material that allows the propeller shield to function as intended in an aquatic environment. Indeed, in some non-limiting embodiments, the propeller shield can comprise one or more durable materials that are resistant to corrosion.

Examples of such corrosion-resistant materials include, but are not limited to, a metal, such as aluminum, stainless steel, etc.; a plastic, such as nylon, polyethylene, polyurethane, a polymer, etc.; a ceramic material; and/or any other suitable material that is resistant to corrosion and is dense enough to sink and pivot over the distal face of the propeller 100 when the boat is at rest or in reverse.

The various components of the propeller shield 10 can be made in any suitable manner. By way of non-limiting example, the various components can be stamped, molded, extruded, cut, grinded, bent, or otherwise shaped to form the described components of the propeller shield. Additionally, the various components of the propeller shield can be connected to each other in any suitable manner, including, but not limited to, by welding, through the use of mechanical fasteners (e.g., nuts and bolts, rivets, etc.), by bonding (e.g., via a chemical adhesive), and/or by any other suitable mechanism. By way of non-limiting illustration, FIG. 3 illustrates an embodiment in which the shield member 15 is attached to the connection mechanism 20 by a plurality of bolts 65.

As discussed above, the described propeller shield 10 has several advantageous characteristics. In one non-limiting example, the shield member 15 is capable of preventing serious injury due to unintentional contact with the distal face of the propeller 100. In another non-limiting example, because some embodiments of the propeller shield automatically pivot between an engaged position and an unengaged position, the shield's ability to prevent accidents is not dependent on a user manually engaging it. In still another non-limiting example, because some embodiments of the propeller shield automatically pivot away from the propeller's distal face and skim across the surface of the water, such embodiments may have few, if any, adverse effects on the boat's speed and handling.

Example

In order to show that the described propeller shield 10 has little to no adverse effect on the performance of a boat, several performance characteristics for a boat using the propeller shield were measured and compared against the performance characteristics measured from the same boat without the propeller shield. The various measurements for the boat with the propeller shield and the boat without the propeller shield were then averaged. These averaged measurements, which are not limiting in any manner, are shown below in Table 1.

TABLE 1

| Performance Characteristic Measured | With Shield | Without Shield |
|---|---|---|
| 0-25 mph Average Time | 11.72 seconds | 11.58 seconds |
| 0-20 mph Average Time | 9.55 seconds | 9.19 seconds |
| On Plane Average Time and Speed | 8.20 seconds at 17.2 mph | 7.86 seconds at 17.2 mph |
| Average Top Speed | 41.34 mph | 41.25 mph |

Specifically, Table 1 shows that the while the propeller shield 10 may have slightly reduced the boat's acceleration, the propeller shield's use may have actually increased the boat's top speed. In sum, Table 1 shows that the propeller shield has little to no adverse effect on the boat's performance speed.

While specific embodiments of the present invention have been illustrated and described, numerous modifications come to mind without significantly departing from the spirit of the invention, and the scope of protection is only limited by the scope of the accompanying claims and not by any of the aforementioned embodiments or examples.

The invention claimed is:

1. A boat propeller shield, comprising:

a shield member being sized and shaped to cover a face of a boat propeller, the shield member comprising a plate defining a plurality of vents;

a connection mechanism to pivotally attach the shield member to the boat in a manner that allows the shield member to pivot over the propeller's face into an engaged position when the boat is at rest or moving in reverse though water and to pivot away from the propeller's face into a disengaged position as the boat moves forward and water is forced against a proximal face of the shield member that faces towards the propeller when the shield member is in the engaged position, wherein the connection mechanism comprises an angled arm having a pivot point at its first end, wherein a second end of the angled arm is coupled to the shield member, and wherein the angled arm is bent at an angle between its first and second end; and a hydroplane member that is disposed at, and extends from, the proximal face of the shield member so as to extend towards the propeller's face when the shield member is in the engaged position.

2. The propeller shield of claim 1, wherein the boat propeller shield comprises:

an attachment end that comprises the pivot point of the connection mechanism; and an opposing end that is opposite to, and disposed farthest from, the attachment end, and wherein the hydroplane member is disposed at the opposing end to substantially lift the shield member out of the water when the boat is moving forward in the water at a sufficiently high speed.

3. The propeller shield of claim 1, wherein the plurality of vents comprises elongated vents to provide fluid flow to the propeller when the shield member is pivoted into the engaged position.

4. The propeller shield of claim 1, wherein the hydroplane member is further disposed centrally at the proximal face of the shield member.

5. The propeller shield of claim 1, wherein the shield member defines an indentation that allows an anti-ventilation board of a motor of the boat to pass through the indentation without contacting the shield member when the shield member is attached to the boat and is pivoted between the engaged position and the unengaged position.

6. The propeller shield of claim 3, wherein the plurality of elongated vents runs vertically through the shield member when the shield member is attached to the boat.

7. The propeller shield of claim 1, wherein the connection mechanism comprises a shield member stop that is configured to contact a part of the boat to limit the shield member's movement towards the propeller's face.

8. The propeller shield of claim 1, wherein the propeller shield is attached to the boat, wherein the boat comprises a propeller guard around a perimeter of the propeller, and wherein the propeller shield is sized and shaped to substantially cover an opening of a propeller guard.

9. A boat propeller shield, comprising:

a shield member that is sized and shaped to cover a face of a boat propeller, wherein the shield member comprises a plate having a plurality of vents to provide fluid flow to the propeller when the shield member is pivoted over the propeller's face in an engaged position;

a connection mechanism to pivotally attach the shield member to the boat in a manner that allows the shield member to pivot over the propeller's face into the engaged position when the boat is at rest or moving in reverse through water and that allows the shield member to pivot away from the propeller's face into a disengaged position as the boat moves forward and water is forced against a proximal face of the shield member, which faces towards the propeller when the shield member is in the engaged position, wherein the connection mechanism comprises an angled arm having a pivot point at its first end to pivotally attach the shield member to the boat, wherein a second end of the angled arm is coupled to the shield member, and wherein the angled arm comprises an angular bend between its first and second end; and a hydroplane member that is disposed at, and extends from, the proximal face of the shield member so as to extend towards the propeller's face when the shield member is in the engaged position, wherein the hydroplane member is further disposed centrally at a portion of the shield member that is disposed farthest from the pivot point.

10. The propeller shield of claim 9, wherein the plurality of vents comprises elongated vents that run vertically through the shield member when the shield member is pivotally attached to the boat.

11. The propeller shield of claim 9, wherein the hydroplane member comprises a wedge-shaped object.

12. The propeller shield of claim 9, wherein the connection mechanism comprises a shield member stop that is configured to contact a part of the boat to limit the shield member's movement towards the propeller's face.

13. The propeller shield of claim 9, wherein the propeller shield is mounted to the boat, wherein the boat has a separate propeller guard that extends around a perimeter of the propeller, and wherein the shield member is sized and shaped to substantially cover an opening of a the propeller guard that exposes the propeller's face.

14. A boat having a boat propeller shield, comprising:

a motorized boat having a propeller;

a propeller guard that extends around a perimeter of the propeller;

a boat propeller shield, comprising:

a shield member being sized and shaped to cover a face of the propeller, wherein the shield member comprises a plate that defines a plurality of vents, and wherein the shield member is sized and shaped to substantially cover an opening of a the propeller guard when the shield member is pivoted over the propeller's face into an engaged position;

a connection mechanism that pivotally attaches the shield member to the boat in a manner that allows the shield member to pivot over the propeller's face in the engaged position when the boat is at rest or moving in reverse through water and to pivot away from the propeller's face into a disengaged position as the boat moves forward and water is forced against a proximal face of the shield member, which faces towards the propeller when the shield member is in the engaged position, wherein the connection mechanism comprises an angled arm having a pivot point at its first end to pivotally attach the shield member to the boat, wherein a second end of the angled arm is coupled to the shield member, and wherein the angled arm comprises an angular bend between its first and second end; and a hydroplane member that is disposed at, and extends from, the proximal face of the shield member so as to extend towards the propeller's face when the shield member is pivoted into the engaged position.

15. The boat of claim 14, wherein the angled arm of the connection mechanism comprises an L-shaped appearance from its side view.

16. The boat of claim 14, wherein the plurality of vents comprises elongated vents to provide fluid flow to the propeller when the shield member is pivoted over the propeller's face.

17. The boat of claim 14, wherein the hydroplane member is further disposed centrally at a portion of the shield member that is disposed farthest from the pivot point.

18. The boat of claim 14, wherein the hydroplane member comprises a wedge-shaped object.

19. The boat of claim 14, wherein the connection mechanism comprises a shield member stop that is configured to contact a part of the boat to limit the shield member's movement towards the propeller's face.

20. The boat of claim 16, wherein the elongated vents run vertically through the shield member.

* * * * *